US008017069B2

(12) United States Patent
Kendall

(10) Patent No.: US 8,017,069 B2
(45) Date of Patent: Sep. 13, 2011

(54) CERAMIC SEATING STONE AND METALLURGICAL VESSEL

(75) Inventor: Martin Kendall, Hasselt (BE)

(73) Assignee: Heraeus Electro-Nite International N.V., Houthalen (BE)

( * ) Notice: Subject to any disclaimer, the term of this patent is extended or adjusted under 35 U.S.C. 154(b) by 0 days.

(21) Appl. No.: 11/610,549

(22) Filed: Dec. 14, 2006

(65) Prior Publication Data

US 2007/0138716 A1 Jun. 21, 2007

(30) Foreign Application Priority Data

Dec. 20, 2005 (DE) ..... 10 2005 061 291

(51) Int. Cl.
*C21B 7/06* (2006.01)

(52) U.S. Cl. ..... 266/236; 222/594; 222/597

(58) Field of Classification Search ..... 266/236, 266/271; 222/594, 597, 607
See application file for complete search history.

(56) References Cited

U.S. PATENT DOCUMENTS

| | | | | |
|---|---|---|---|---|
| 5,563,106 | A | 10/1996 | Binner et al. | |
| 5,858,260 | A | 1/1999 | Daussan et al. | |
| 7,028,868 | B2 * | 4/2006 | Kendall et al. | 222/594 |
| 2003/0011113 | A1 * | 1/2003 | Kendall et al. | 266/216 |
| 2003/0148089 | A1 * | 8/2003 | Cooymans et al. | 428/304.4 |
| 2006/0076720 | A1 | 4/2006 | Kendall et al. | |

FOREIGN PATENT DOCUMENTS

| | | | |
|---|---|---|---|
| DE | 2807123 | A1 | 8/1979 |
| DE | 10150032 | C2 | 1/2003 |
| EP | 0653261 | A1 | 10/1994 |
| EP | 0916436 | A1 | 11/1998 |
| JP | 63119971 | A | 5/1988 |
| JP | 1131079 | A | 5/1989 |
| JP | 2003112257 | A | 4/2003 |

OTHER PUBLICATIONS

Japanese Office Action dated Jan. 18, 2011 from the Japanese Patent Office in Japanese Patent Application No. 2006-339989 (English translation thereof).

Japanese Office Action dated Jun. 7, 2011 from the Japanese Patent Office in Japanese Patent Application No. 2006-339989 (English translation thereof).

* cited by examiner

*Primary Examiner* — Scott Kastler
(74) *Attorney, Agent, or Firm* — Panitch Schwarze Belisario & Nadel LLP

(57) ABSTRACT

A ceramic seating stone is provided for use in or on a metallurgical vessel for holding molten metal. The stone is formed as a whole or in parts of ceramic fibers, hollow ceramic spheres and/or foam ceramics.

14 Claims, 2 Drawing Sheets

CERAMIC SEATING STONE AND METALLURGICAL VESSEL

BACKGROUND OF THE INVENTION

The invention relates to a ceramic seating stone for use in or on a metallurgical vessel for holding molten metal. The invention also relates to a metallurgical vessel having such a ceramic seating stone.

Arrangements of this nature are particularly used in connection with metals having high melting points, such as molten steel, iron and cast iron. In these cases, such parts are used as vessels linings, as what are called seating stones or as part of the nozzle. A seating stone is arranged at the nozzle aperture of a vessel for molten metal; the upper part of a metallurgical nozzle fits into the seating stone.

Known devices are described, for example, in U.S. Pat. No. 5,858,260 or in German Patent DE 101 50 032 C2. Seating stones are also known from European patent application publications EP 653 261 A1 or EP 916 436 A1. Seating stones with a limited, open porosity are also described in German published patent application DE 28 07 123 A1.

BRIEF SUMMARY OF THE INVENTION

The invention is based on the problem of optimization of the material of known parts, for example to achieve a reduction in density but, at the same time, with increased insulation properties.

A ceramic seating stone formed in whole or in part from ceramic fibers, hollow ceramic spheres or foam ceramic exhibits a lower density compared with solid materials, but also exhibits improved thermal insulation properties at the same time. In such a case, it is advisable that at least one of the seating stone's surfaces intended to come into contact with the molten metal be formed of ceramic fibers, hollow ceramic spheres or foam ceramic.

The ceramic fibers, hollow ceramic spheres or foam ceramic are preferably formed of at least 95%, and particularly of at least 99.5%, pure material selected from the group of aluminum oxide (preferably stabilized), zirconium dioxide, magnesium oxide, calcium oxide, and spinel. The material preferably exhibits closed porosity with a relative porosity preferably over 25%. It is advisable that the ceramic seating stone exhibit a density of at most 80% of the theoretical density and a thermal conductivity which ideally does not exceed 1 W/mK. Such a low thermal conductivity has proved to be advantageous under the above conditions.

In the invention, the problem is solved by a ceramic seating stone, which is formed in whole or in part from at least 95% pure material selected from the group of aluminum oxide (preferably stabilized), zirconium dioxide, magnesium oxide, and calcium oxide, formed as spinel. At least one of the seating stone's surfaces intended to come into contact with the molten metal is formed of at least 95% pure material, and a purity of at least 99.5% is advantageous. The material is preferably formed of ceramic fibers, hollow ceramic spheres or foamed ceramic.

The outer diameter of the seating stone is at least 2 times, preferably at least 3 times, as large as its inner diameter, measured in the same direction.

The seating stone described above is part of the inventive metallurgical vessel, having an outlet or outflow opening with a nozzle, wherein the seating stone is arranged at the upper part of the nozzle and wherein an outer diameter of the seating stone is at least 4 times, preferably at least 6 times, as large as an inner diameter of the nozzle, measured in the same direction. The vessel comprises particularly a lining made of ceramic fibers, hollow ceramic spheres or foam ceramic material, wherein the lining is formed of at least 95% and particularly at least 99.5% pure material.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
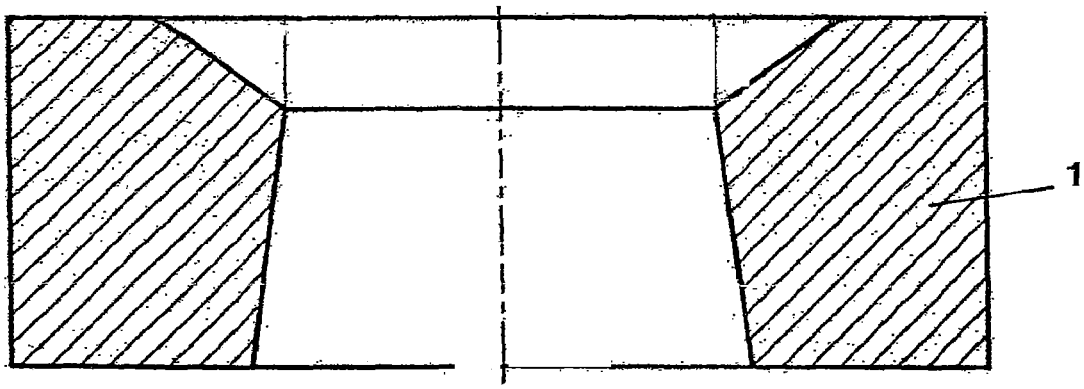
FIG. 1 is an axial cross-section through a seating stone.
Figure 2:
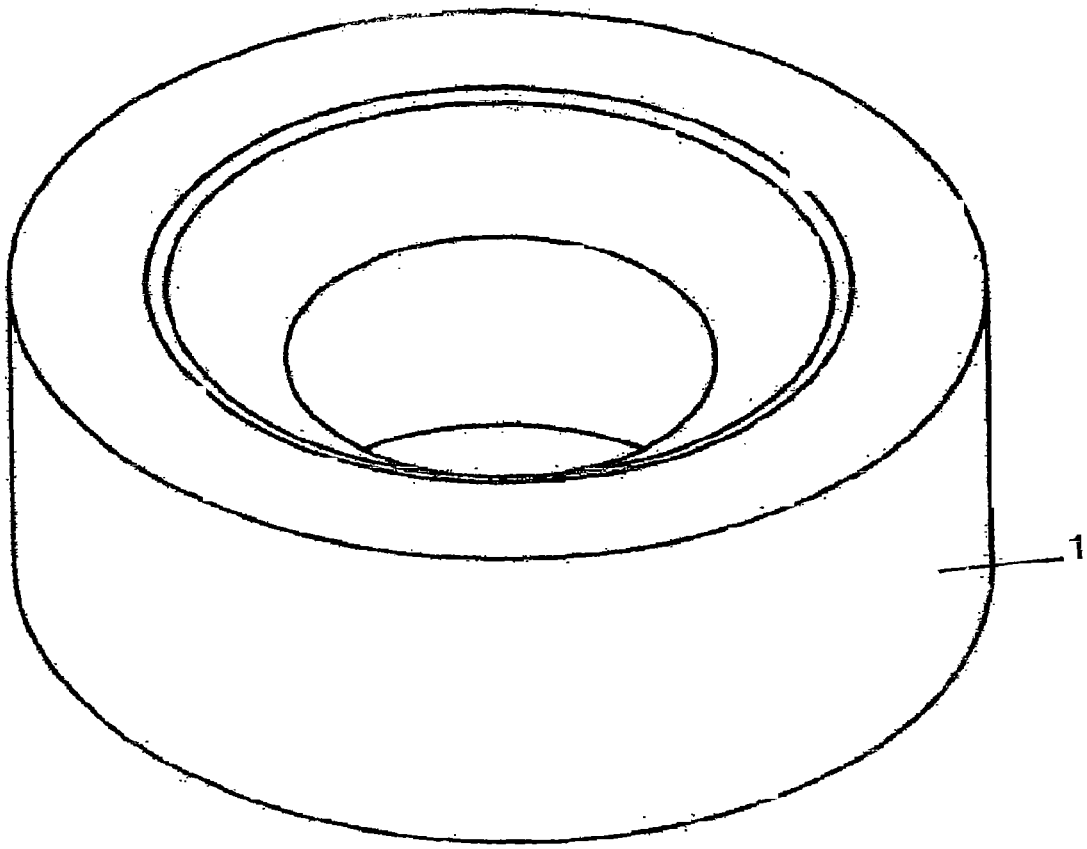
FIG. 2 is a top perspective view of a seating stone.

The seating stone 1 illustrated in FIGS. 1 and 2 is formed essentially of 99.5% pure aluminum oxide in the form of hollow spheres. The material exhibits a porosity of >25% and a density of less than 80% of the theoretical density of the material. The thermal conductivity is less than 1 W/mK. The ratio of outer diameter to inner diameter is about 2.3:1.

Figure 3:
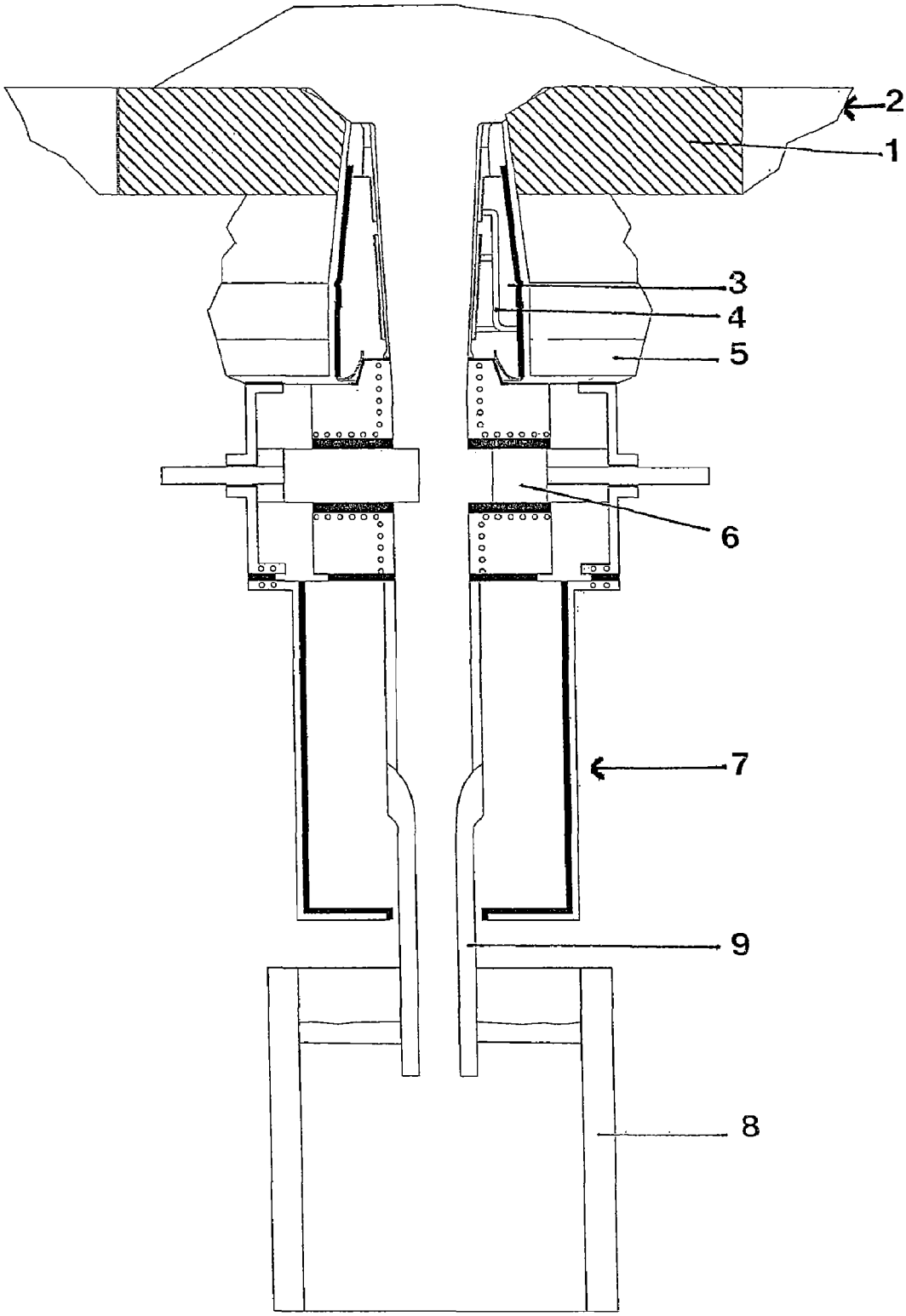
FIG. 3 is a longitudinal cross-section through the nozzle of a metallurgical vessel.

FIG. 3 shows a bottom nozzle of a metallurgical vessel, which is adjacent to a seating stone 1. The seating stone 1 is arranged in the wall 2 of the metallurgical vessel. The vessel is a distribution device for molten steel. The bottom nozzle has an upper orifice 3. Electrodes 4 are arranged in this orifice 3 to produce an electro-chemical effect or for heating purposes. The wall 2 itself has several different layers composed of refractory material and has a steel casing 5 on the outside. A sliding valve 6 is arranged under the upper orifice 3 to regulate the flow of the molten metal. A lower orifice 7 is arranged below this and extends into the molten metal container 8. The latter forms, for example, part of a continuous casting machine for steel. The part 9 of the lower orifice 7 which extends directly into the molten metal container 8 consists principally of zirconium dioxide. The ratio of outer diameter of the seating stone 1 to the inner diameter of the nozzle 3 is about 4.5:1.

The material used for the ceramic part according to the invention has good insulation properties and a closed porosity which prevents the penetration of molten steel. At the same time, it has a relatively low density and does not react with the molten steel. It therefore has a relatively lengthy working life and, at the same time, also provides advantageous properties when in contact with the molten steel, in so far as the molten steel and its component parts do not adhere to the material or adhere only to a very limited extent. The material can therefore be used in direct contact with the molten steel as shown in FIG. 3.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A ceramic seating stone for use in or on a metallurgical vessel for holding molten metal, wherein at least one surface of the seating stone provided for contact with the molten metal is formed of a material selected from the group consisting of ceramic fibers, hollow ceramic spheres, foam ceramics and mixtures thereof, and wherein the material exhibits a maximum density of 80% of its theoretical density and a closed porosity.

2. The ceramic seating stone according to claim 1, wherein the material is at least 95% pure material, and is selected from the group consisting of aluminum oxide, zirconium dioxide, magnesium oxide, calcium oxide, and spinel.

3. The ceramic seating stone according to claim 2, wherein the material consists essentially of stabilized aluminum oxide.

4. The ceramic seating stone according to claim 2, wherein the material is at least 99.5% pure material.

5. The ceramic seating stone according to claim 1, wherein an outer diameter of the stone is at least two times as large as an inner diameter of the stone, measured in the same direction.

6. The ceramic seating stone according to claim 1, wherein the material exhibits a porosity of more than 25%.

7. The ceramic seating stone according to claim 1, wherein the stone exhibits a maximum thermal conductivity of 1 W/mK.

8. A metallurgical vessel comprising a nozzle and a seating stone according to claim 1, wherein the seating stone is arranged at an upper part of the nozzle and wherein an outer diameter of the seating stone is at least four times as large as an inner diameter of the nozzle, measured in the same direction.

9. The metallurgical vessel according to claim 8, wherein the stone has a lining of a material selected from the group consisting of ceramic fibers, hollow ceramic spheres, foam ceramics, and mixtures thereof.

10. The metallurgical vessel according to claim 8, wherein the stone has a lining of an at least 95% pure material selected from the group consisting of aluminum oxide, zirconium dioxide, magnesium oxide, calcium oxide, and spinel.

11. The metallurgical vessel according to claim 10, wherein the material is at least 99.5% pure.

12. The metallurgical vessel according to claim 8, wherein an outer diameter of the seating stone is at least six times as large as an inner diameter of the nozzle.

13. The ceramic seating stone according to claim 1, wherein the whole seating stone is formed of the material.

14. The metallurgical vessel according to claim 8, wherein the whole seating stone is formed of the material.

* * * * *